US010808721B2

(12) United States Patent
Ikeguchi et al.

(10) Patent No.: US 10,808,721 B2
(45) Date of Patent: Oct. 20, 2020

(54) INTAKE STRUCTURE OF COMPRESSOR

(71) Applicant: KAWASAKI JUKOGYO KABUSHIKI KAISHA, Kobe-shi, Hyogo (JP)

(72) Inventors: Takuya Ikeguchi, Kobe (JP); Koji Terauchi, Kobe (JP); Keiji Oikaze, Akashi (JP); Naoto Sakai, Osaka (JP); Kazuhiko Tanimura, Akashi (JP)

(73) Assignee: KAWASAKI JUKOGYO KABUSHIKI KAISHA, Hyogo, Kobe-shi (JP)

( * ) Notice: Subject to any disclaimer, the term of this patent is extended or adjusted under 35 U.S.C. 154(b) by 151 days.

(21) Appl. No.: 15/767,419

(22) PCT Filed: Oct. 7, 2016

(86) PCT No.: PCT/JP2016/004522
§ 371 (c)(1),
(2) Date: Apr. 11, 2018

(87) PCT Pub. No.: WO2017/064853
PCT Pub. Date: Apr. 20, 2017

(65) Prior Publication Data

US 2018/0298919 A1 Oct. 18, 2018

(30) Foreign Application Priority Data

Oct. 14, 2015 (JP) ..... 2015-202980

(51) Int. Cl.
*F04D 29/54* (2006.01)
*F04D 29/52* (2006.01)
*F04D 19/02* (2006.01)

(52) U.S. Cl.
CPC ..... *F04D 29/544* (2013.01); *F04D 19/02* (2013.01); *F04D 29/522* (2013.01);
(Continued)

(58) Field of Classification Search
CPC .... F04D 29/541; F04D 29/542; F04D 29/544; F04D 29/547; F05D 2210/43; F05D 2250/41
See application file for complete search history.

(56) References Cited

U.S. PATENT DOCUMENTS 2,733,853 A * 2/1956 Trumpler ..... F04D 29/4213 415/161
2,912,156 A * 11/1959 Gentile ..... F04D 29/541 415/194
(Continued)

FOREIGN PATENT DOCUMENTS

JP 10-318191 A 12/1998
JP 2009-174331 A 8/2009
(Continued)

OTHER PUBLICATIONS

International Search Report for PCT/JP2016/004522, dated Dec. 27, 2016.

*Primary Examiner* — Moshe Wilensky
*Assistant Examiner* — Christopher R Legendre
(74) *Attorney, Agent, or Firm* — Sughrue Mion, PLLC

(57) ABSTRACT

An intake structure of a compressor includes an intake duct forming an intake port opening in a direction away from a central axis of the compressor and a bellmouth forming an annular channel expanding from an inlet of the compressor toward an inner space of the intake duct. The bellmouth includes a plurality of struts connecting an inner casing positioned inside the annular channel and an outer casing positioned outside the annular channel. At least one of a plurality of transverse struts, of the plurality of struts, which are located on both sides of a center plane passing through the central axis of the compressor and the center of the intake port has a trailing edge positioned on a virtual plane passing through the central axis of the compressor and a
(Continued)

leading edge positioned on a side of the intake port with respect to the virtual plane.

6 Claims, 10 Drawing Sheets

(52) U.S. Cl.
CPC ..... *F04D 29/547* (2013.01); *F05D 2210/43* (2013.01); *F05D 2250/51* (2013.01)

(56) References Cited

U.S. PATENT DOCUMENTS

| | | | | |
|---|---|---|---|---|
| 7,625,173 | B2 * | 12/2009 | Mehring | F04D 29/701 415/121.2 |
| 8,206,097 | B2 * | 6/2012 | Nagai | F04D 29/522 415/195 |
| 2011/0311356 | A1 | 12/2011 | Masutani | |
| 2013/0287542 | A1 * | 10/2013 | Nichols | F01D 5/141 415/1 |
| 2015/0056069 | A1 | 2/2015 | Masutani et al. | |
| 2018/0298919 | A1 * | 10/2018 | Ikeguchi | F04D 29/547 |

FOREIGN PATENT DOCUMENTS

| | | | |
|---|---|---|---|
| JP | 2010-203251 | A | 9/2010 |
| JP | 5129588 | B2 | 1/2013 |
| SU | 1211419 | A | 2/1986 |
| WO | 2013128539 | A1 | 9/2013 |

* cited by examiner

[Fig. 1]
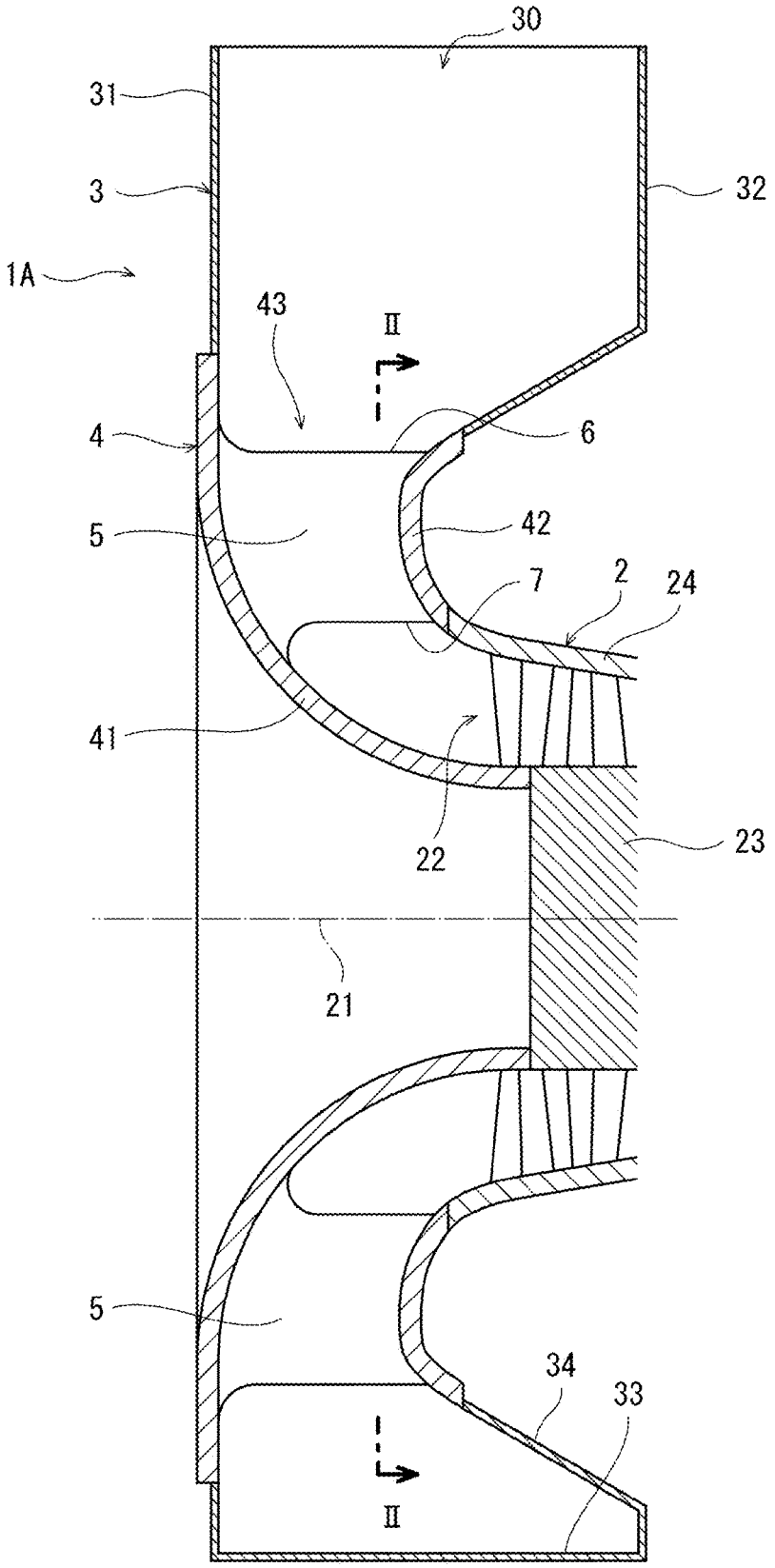

[Fig. 2]
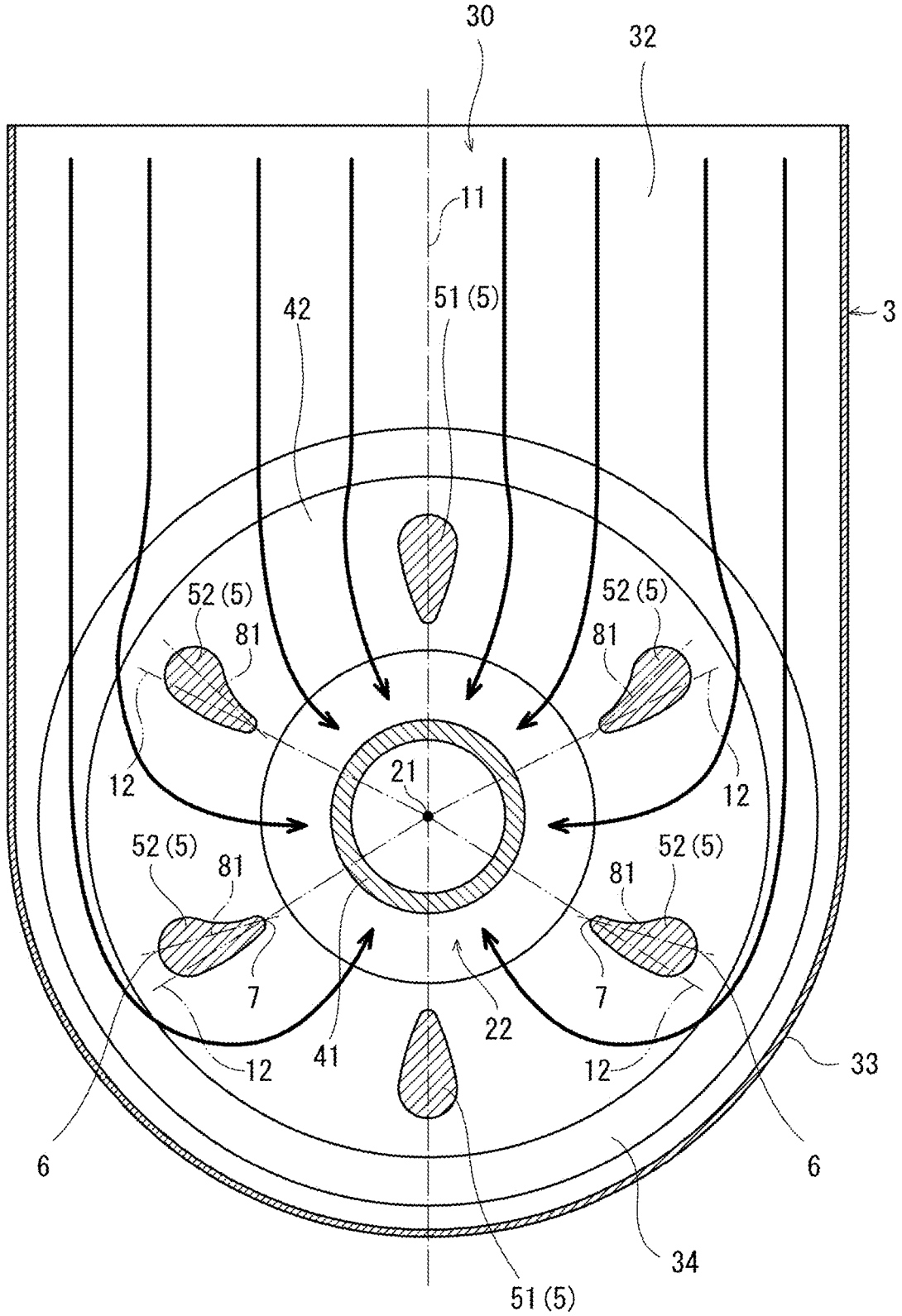

[Fig. 3]
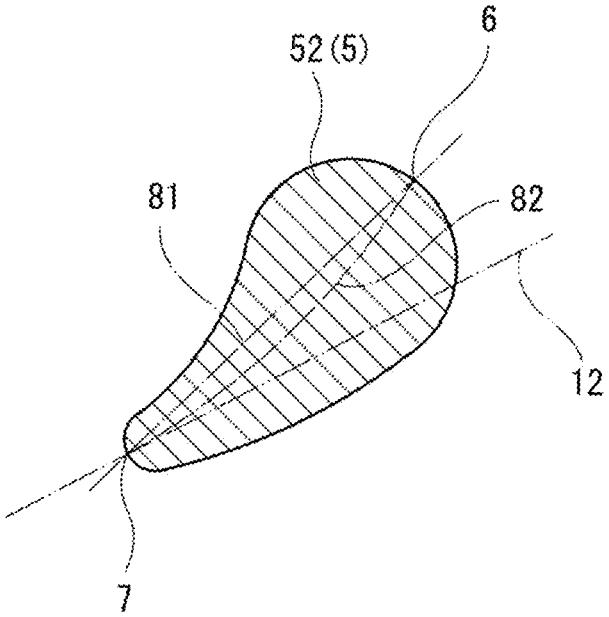

[Fig. 4]
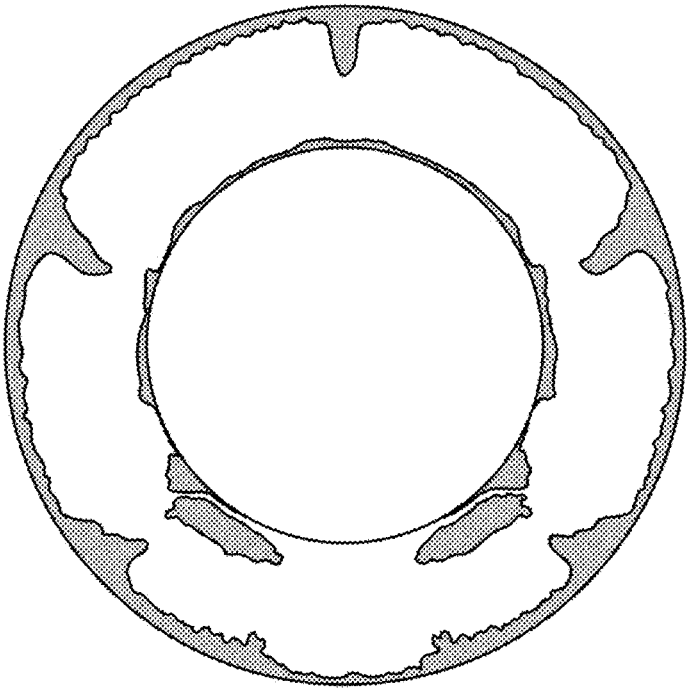
[Fig. 5]
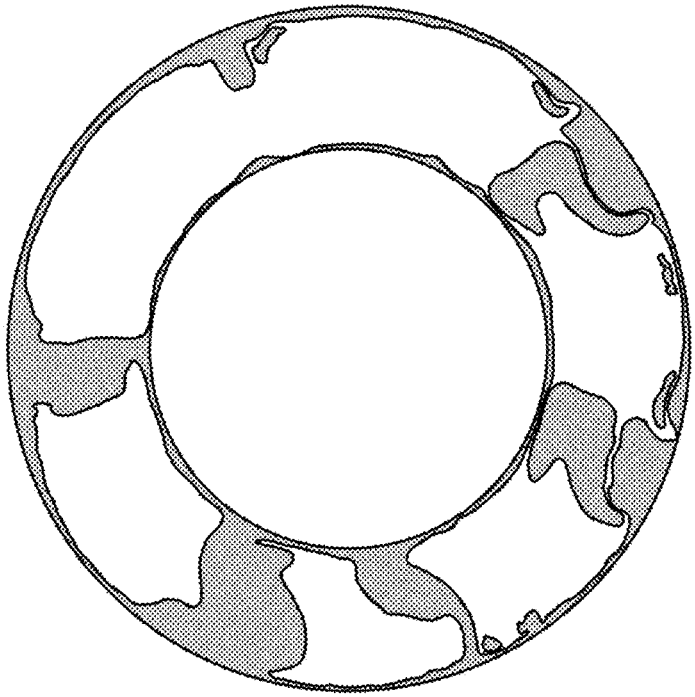

[Fig. 6]
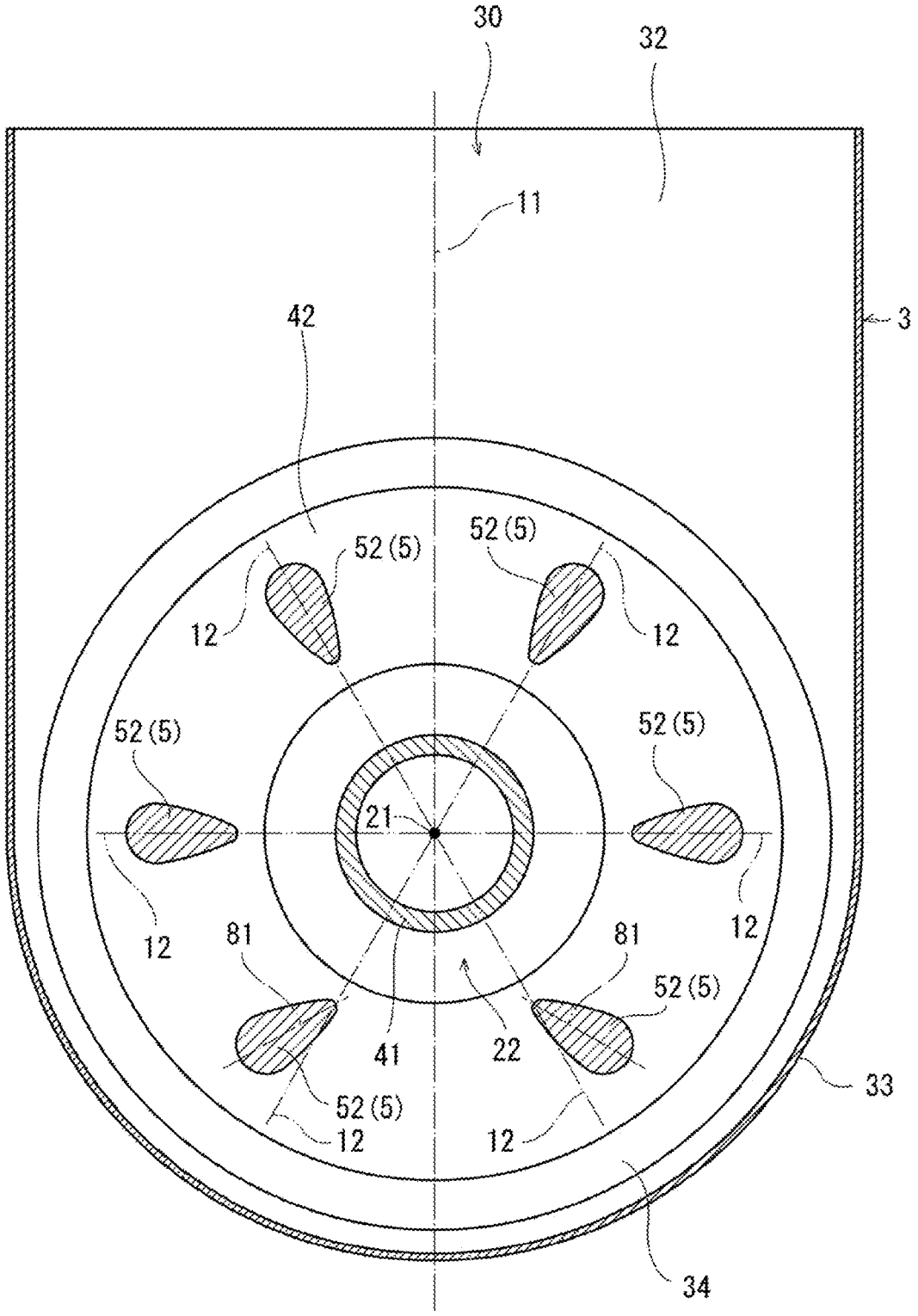

[Fig. 7]
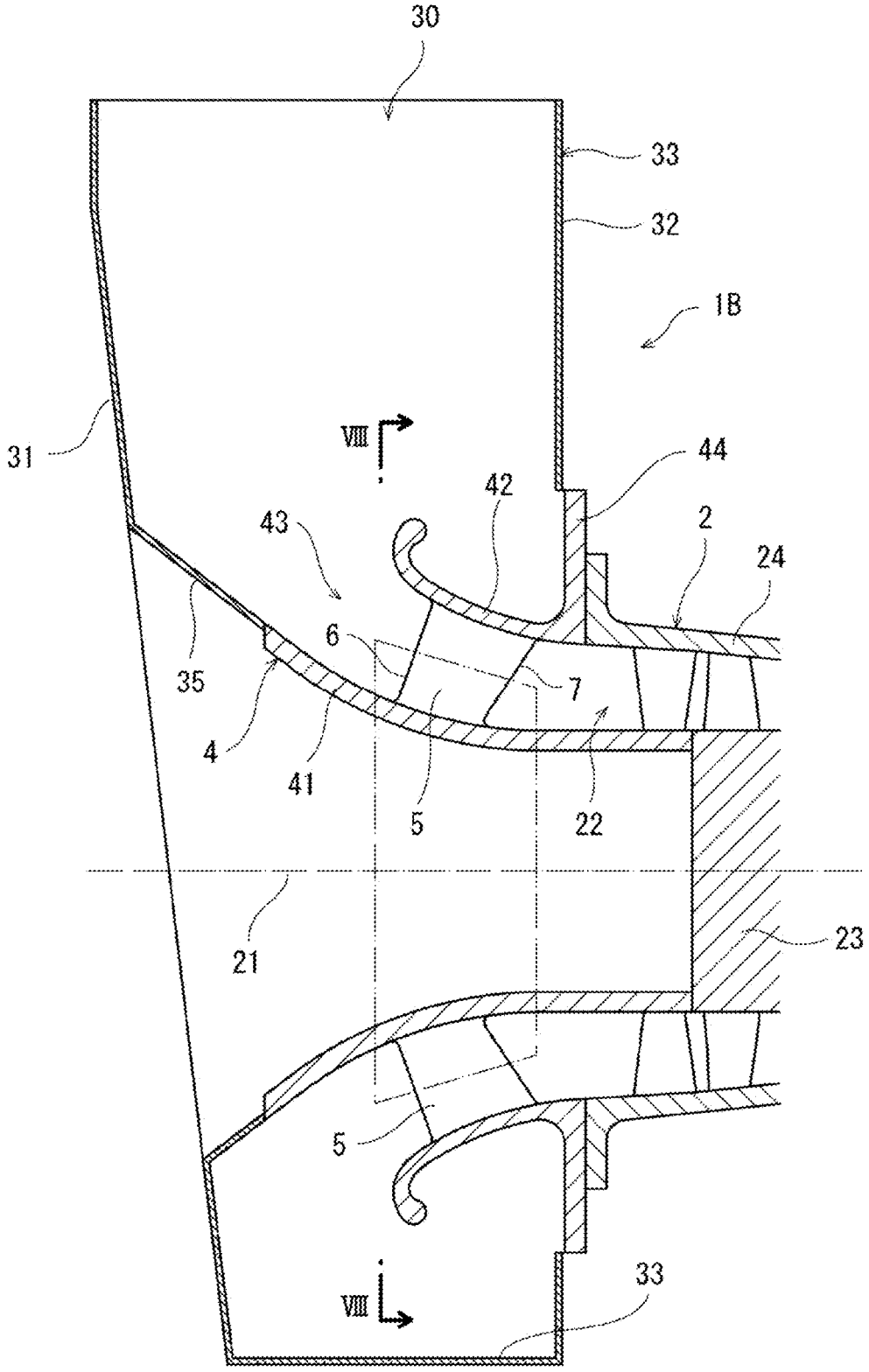

[Fig. 8]
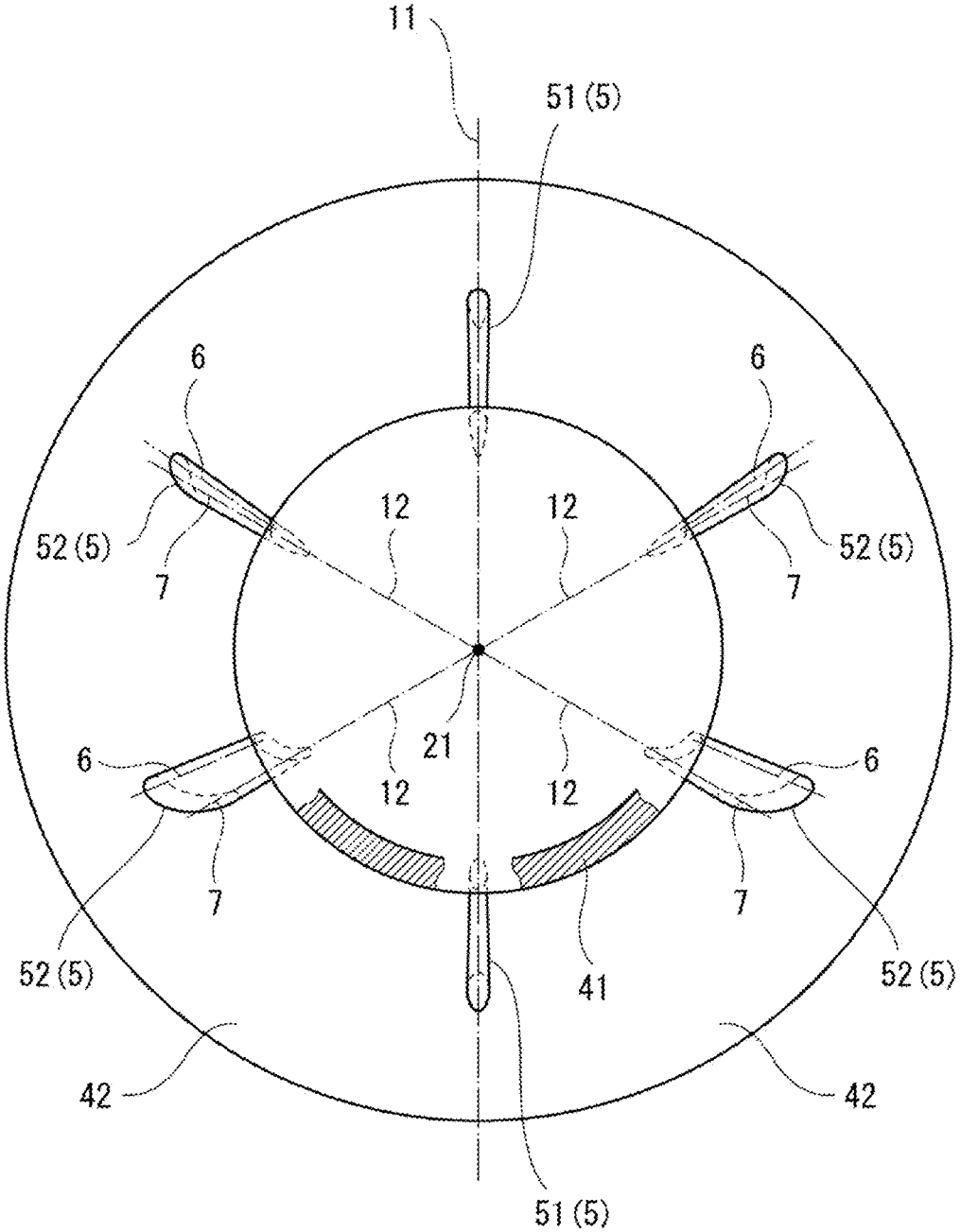

[Fig. 9A]
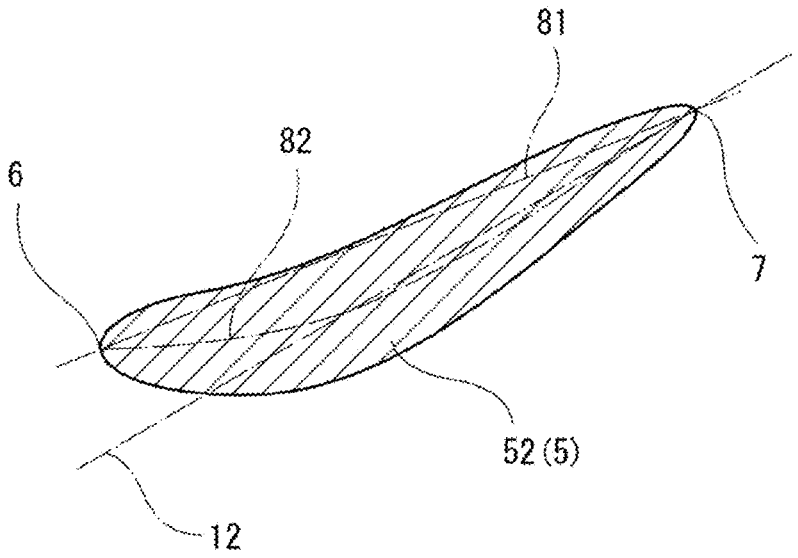
[Fig. 9B]
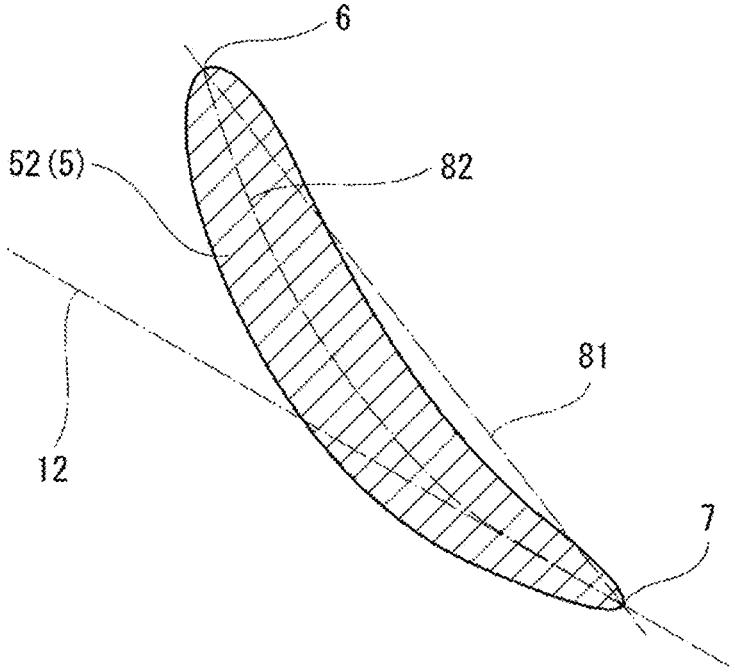

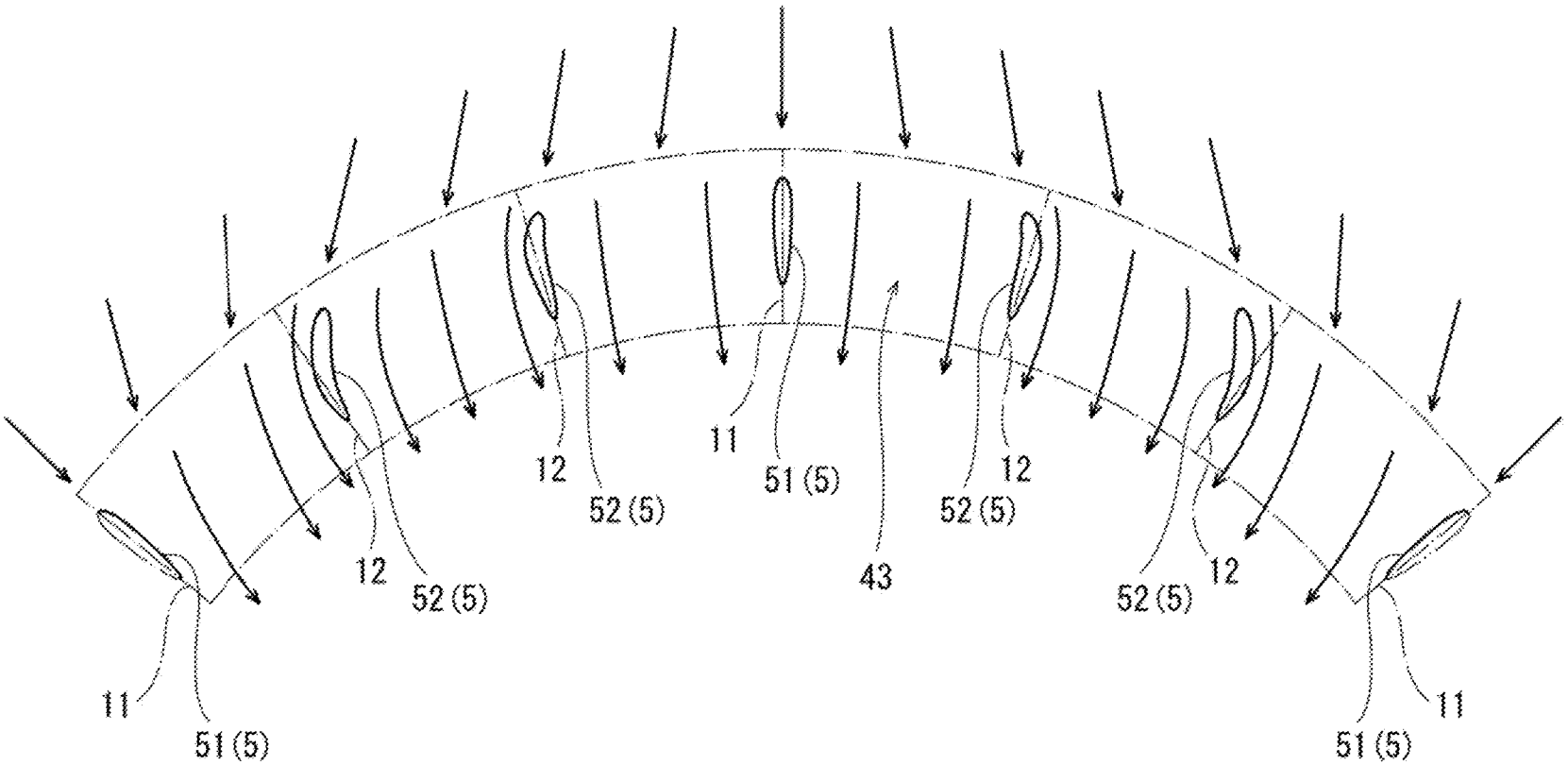
[Fig. 10]

[Fig. 11]
PRIOR ART
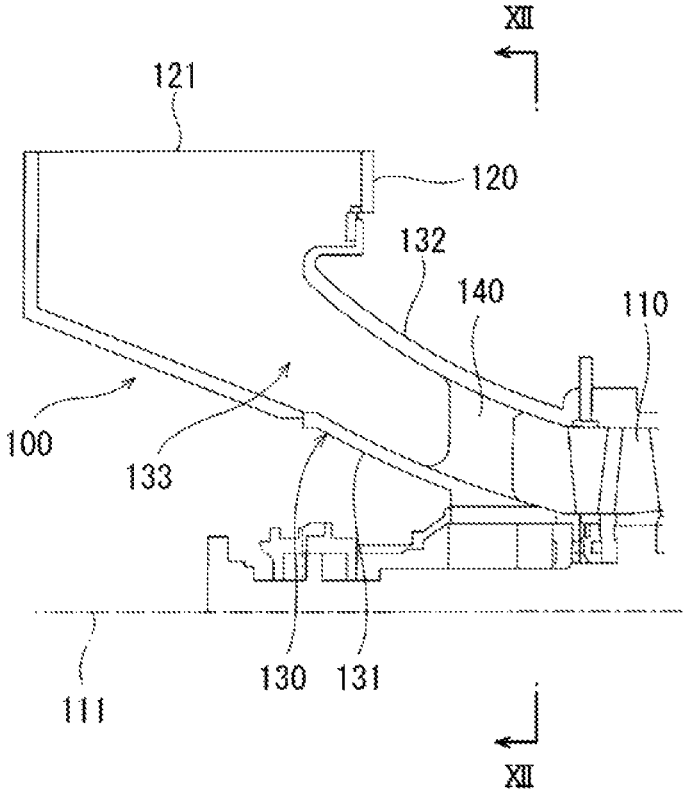
[Fig. 12]
PRIOR ART
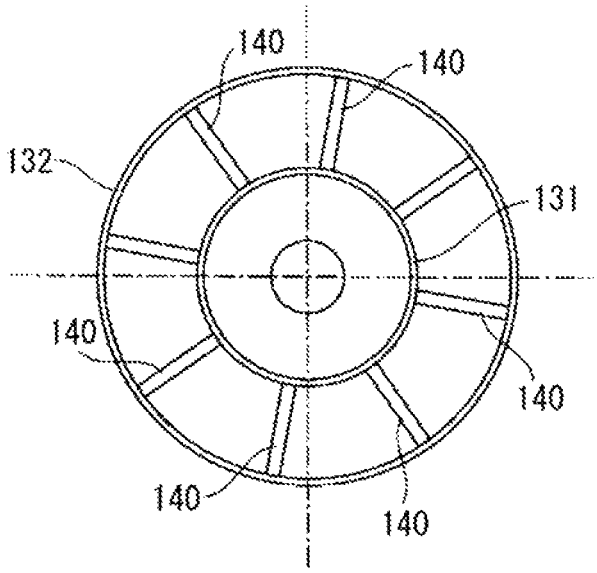

INTAKE STRUCTURE OF COMPRESSOR

This application is a National Stage of International Application No. PCT/JP2016/004522 filed Oct. 7, 2016, claiming priority based on Japanese Patent Application No. 2015-202980 filed Oct. 14, 2015.

TECHNICAL FIELD

The present invention relates to an intake structure of a compressor.

BACKGROUND ART

Conventionally, an intake structure provided on the upstream side of a compressor to guide intake gas to the compressor has been known. For example, PTL 1 discloses an intake structure 100 of a compressor as shown in FIGS. 11 and 12.

Specifically, the intake structure 100 includes an intake duct 120 forming an intake port 121 and a bellmouth 130 forming an annular channel 133 expanding from an inlet of a compressor 110 toward the internal space of the intake duct 120. Referring to FIG. 11, the intake port 121 opens upward in a direction orthogonal to the axial direction of the compressor 110. The bellmouth 130 includes an inner casing 131 positioned inside the annular channel 133 and an outer casing 132 positioned outside the annular channel 133, and these casings 131 and 132 are connected with a plurality of struts 140. Each of the struts 140 extends in the radial direction around a central axis 111 of the compressor 110.

CITATION LIST

Patent Literature

PTL 1: Japanese Patent No. 5129588

SUMMARY OF INVENTION

Technical Problem

In the intake structure 100 shown in FIGS. 11 and 12, when viewed from the axial direction of the compressor 110, the intake gas that has flowed downward from the intake port 121 into the intake duct 120 flows so as to gather from the entire circumference of the annular channel 133 toward the center. Particularly, on the left and right sides and the lower side of the annular channel 133, the flow direction of the intake gas changes from the downward direction to the transverse direction and upward direction (in other words, the intake gas flows so as to turn around from the lateral sides or the lower side). For such intake flow, struts tend to be obstructive. This increases the pressure loss when the intake gas passes through the annular channel.

Accordingly, an object of the present invention is to provide an intake structure of a compressor which can reduce a pressure loss when intake gas passes through an annular channel.

Solution to Problem

In order to solve the above problem, the intake structure of a compressor according to the present invention includes an intake duct forming an intake port opening in a direction away from a central axis of the compressor, and a bellmouth forming an annular channel expanding from an inlet of the compressor toward an inner space of the intake duct, the bellmouth including an inner casing positioned inside the annular channel, an outer casing positioned outside the annular channel, and a plurality of struts connecting the inner casing and the outer casing. At least one of a plurality of transverse struts, among the plurality of struts, which are located on both sides of a center plane passing through the central axis of the compressor and a center of the intake port has a trailing edge positioned on a virtual plane passing through the central axis of the compressor and a leading edge positioned on a side of the intake port with respect to the virtual plane.

According to the above configuration, at least one of the transverse struts tilts toward the intake port. In a case where intake gas flowing into the intake duct from the intake port changes its direction toward the inlet of the compressor in the annular channel, this configuration therefore reduces the degree of obstruction to the flow of the intake gas by the transverse struts. Therefore, it is possible to reduce the pressure loss when intake gas passes through the annular channel.

At least one of the plurality of transverse struts may be curved from the leading edge toward the trailing edge such that a side surface on the side of the intake port becomes concave. According to this configuration, it is possible to smoothly change the flow direction of intake gas along at least one of the transverse struts.

At least one of the plurality of transverse struts may be curved such that a widthwise center line bisects the transverse strut in a widthwise direction such that the virtual plane is tangential to the widthwise center line at the trailing edge. According to this configuration, the transverse strut can be shaped in conformity with the flow of intake gas at the trailing edge, and the effect of reducing the pressure loss can be more remarkably obtained.

At least two of the plurality of transverse struts may be provided on each of one side and the other side of the center plane, and the transverse strut far from the air intake port may be curved with a curvature larger than that of the transverse strut close to the intake port on each of one side and the other side of the center plane. According to this configuration, the effect of reducing the pressure loss can be more remarkably obtained.

At least two of the plurality of transverse struts may be provided on each of one side and the other side of the center plane, and the transverse strut close to the intake port and the transverse strut far from the intake port on each of one side and the other side of the center plane may be curved with the same curvature. According to this configuration, the manufacturing cost of the bellmouth can be reduced.

For example, the plurality of struts may be provided in a region where a first velocity component of intake gas flowing through the annular channel in a radial direction of the compressor is larger than a second velocity component in the axial direction of the compressor or in a region where the first velocity component is smaller than the second velocity component.

Advantageous Effects of Invention

According to the present invention, it is possible to reduce the pressure loss when intake gas passes through the annular channel.

BRIEF DESCRIPTION OF DRAWINGS

FIG. 1 is a longitudinal sectional view of an intake structure of a compressor according to a first embodiment of the present invention.

FIG. 2 is a transverse sectional view taken along line II-II of FIG. 1.

FIG. 3 is a sectional view of a transverse strut.

FIG. 4 is a view showing an analysis result indicating a pressure loss at an inlet of the compressor according to the intake structure shown in FIGS. 1 and 2.

FIG. 5 is a view showing an analysis result indicating the pressure loss at the inlet of the compressor when all the transverse struts are set to be similar to the longitudinal struts.

FIG. 6 is a transverse sectional view of an intake structure according to a modification of the first embodiment.

FIG. 7 is a longitudinal sectional view of an intake structure of a compressor according to a second embodiment of the present invention.

FIG. 8 is a transverse sectional view taken along line of FIG. 7.

FIGS. 9A and 9B are sectional views of a transverse strut.

FIG. 10 is a developed view of an annular channel along a conical plane indicated by a two-dot chain line in FIG. 7.

FIG. 11 is a longitudinal sectional view of the conventional intake structure of a compressor.

FIG. 12 is a transverse sectional view taken along line XII-XII of FIG. 11.

DESCRIPTION OF EMBODIMENTS

First Embodiment

FIGS. 1 and 2 show an intake structure 1A of a compressor according to a first embodiment of the present invention. The intake structure 1A is provided on the upstream side of a compressor 2 and guides intake gas to the compressor 2.

In this embodiment, the compressor 2 is an axial flow compressor. Axial flow compressors are, for example, incorporated in gas turbine engines. However, the compressor 2 may be a centrifugal compressor or a mixed flow compressor. Further, in this embodiment, a central axis 21 of the compressor 2 is parallel to the horizontal direction. However, the direction of the compressor 2 is not limited to this, and the central axis 21 of the compressor 2 may be parallel to the vertical direction or may be oblique. Hereinafter, for convenience of description, the upstream side of the flow of intake gas in the direction in which the central axis 21 of the compressor 2 extends is also referred to as the front side, and the downstream side is referred to as the rear side.

An intake structure 1 includes an intake duct 3 and a bellmouth 4. The intake duct 3 makes the space around the bellmouth 4 open in one direction. Specifically, the intake duct 3 forms an intake port 30 that opens in a direction away from the central axis 21 of the compressor 2. In this embodiment, the intake port 30 opens upward in a direction orthogonal to the axial direction (the direction in which the central axis 21 extends) of the compressor 2. Note that a relay duct extending in a direction different from the direction in which the intake port 30 opens may be connected to the intake port 30. That is, the intake port 30 may be a bent portion of a duct bent through, for example, at 90°.

More specifically, the intake duct 3 includes a front wall 31 and a rear wall 32 that are perpendicular to the central axis 21 of the compressor 2 and face each other, and a side wall 33 that has a U shape and covers the space between the front wall 31 and the rear wall 32 from the lateral sides and the lower side. That is, the intake port 30 is defined by the upper end of the front wall 31, the upper end of the rear wall 32, and the pair of upper ends of the side wall 33.

A circular opening centered on the central axis 21 of the compressor 2 is provided in the front wall 31 and the rear wall 32. The opening of the rear wall 32 is provided with a tapered wall 34 whose diameter decreases toward the front. On the other hand, an inner casing 41 (to be described later) of the bellmouth 4 is fitted into the opening of the front wall 31.

The bellmouth 4 forms an annular channel 43 expanding from an inlet 22 of the compressor 2 toward the internal space of the intake duct 3. Specifically, the bellmouth 4 includes the inner casing 41 positioned inside the annular channel 43 and an outer casing 42 positioned outside the annular channel 43.

The inner casing 41 increases in diameter so as to change its direction from the axial direction of the compressor 2 to the radial direction from a position close to a rotor 23 of the compressor 2 toward the front and is joined to the front wall 31 of the intake duct 3. For example, a bearing (not shown) for supporting the rotor 23 of the compressor 2 is disposed inside the inner casing 41. The outer casing 42 increases in diameter so as to be reversed from the front end of a casing 24 of the compressor 2 toward the inner peripheral edge of the tapered wall 34 of the intake duct 3.

Therefore, the annular channel 43 opens outward in the radial direction on the upstream side and opens in the axial direction of the compressor 2 on the downstream side. That is, the intake gas that has flowed into the intake duct 3 from the intake port 30 flows into the annular channel 43 from the internal space of the intake duct 3 around the entire circumference of the annular channel 43, and flows into the inlet 22 of the compressor 2, with a velocity component in the axial direction of the compressor 2 increasing in the annular channel 43.

The front portion of the inner casing 41 and the outer casing 42 are connected to each other with a plurality of struts 5 (six in the illustrated example). Each of the struts 5 has a blade shape flattened in the circumferential direction of the compressor 2.

In this embodiment, the strut 5 is provided in a region where a first velocity component of intake gas flowing through the annular channel 43 in the radial direction of the compressor 2 is larger than a second velocity component in the axial direction of the compressor 2. In other words, a region where the first velocity component of intake gas is larger than the second velocity component is a region where the angle defined by the widthwise center line of the annular channel 43 and the central axis 21 Is larger than 45° when viewed in a cross-section passing through the central axis 21 of the compressor 2. More specifically, the strut 5 is disposed at the vicinity of the inlet of the annular channel 43.

Each strut 5 extends in the axial direction of the compressor 2. Accordingly, a leading edge 6 positioned at an outside of each strut 5 in the radial direction and a trailing edge 7 positioned at an inside of the strut 5 in the radial direction are parallel to the central axis 21 of the compressor 2. The width of each strut 5 is maximum at a position closer to the leading edge 6 than the center of the strut 5.

The struts 5 are arranged radially around the central axis 21 of the compressor 2. In this embodiment, the struts 5 include two longitudinal struts 51 positioned on a center plane 11 passing through the central axis 21 of the compressor 2 and the center of the intake port 30 and two (total four) transverse struts 52 on each of one side and the other side of the center plane 11.

The leading edge 6 and the trailing edge 7 of each longitudinal strut 51 are located on the center plane 11. Accordingly, a chord line connecting the leading edge 6 and the trailing edge 7 of each longitudinal strut 51 coincides with the center plane 11. In addition, each longitudinal strut 51 is symmetrical with respect to the chord line. Therefore, the widthwise center line bisecting each longitudinal strut 51 in the widthwise direction also coincides with the center plane 11.

On the other hand, the leading edge 6 and the trailing edge 7 of each transverse strut 52 are not located on the identical plane passing through the central axis 21 of the compressor 2. Specifically, each of the transverse struts 52 has the trailing edge 7 located on a virtual plane 12 passing through the central axis 21 of the compressor 2 and the leading edge 6 positioned on the intake port 30 side with respect to the virtual plane 12. In other words, each of the transverse struts 52 tilts toward the intake port 30, and the leading edge 6 is located at a position separated upward from the virtual plane 12.

Each transverse strut 52 is not symmetrical with respect to a chord line 81 but is curved from the leading edge 6 toward the trailing edge 7 so that the side surface of the transverse strut 52 facing the intake port 30 becomes concave. Accordingly, as shown in FIG. 3, a widthwise center line 82 bisecting each transverse strut 52 in the widthwise direction is a camber line positioned below the chord line 81.

In this embodiment, each transverse strut 52 is curved such that the virtual plane 12 virtual plane 12 is tangential to the widthwise center line 82 at the trailing edge 7. Furthermore, in this embodiment, on each of one side and the other side of the center plane 11, the upper transverse strut 52 near the intake port 30 and the lower transverse strut 52 far from the intake port 30 are curved with the same curvature. In other words, all the transverse struts 52 have the same shape.

As described above, in the intake structure 1A according to this embodiment, all the transverse struts 52 tilt toward the intake port 30. In a case where intake gas flowing into the intake duct 3 from the intake port 30 changes its direction toward the inlet 22 of the compressor 2 inside the annular channel 43, this configuration therefore reduces the degree of obstruction to the flow of the intake gas by the transverse struts 52. Therefore, it is possible to reduce the pressure loss when the intake gas passes through the annular channel 43. In addition, because circumferential drift at the inlet 22 of the compressor 2 is restrained, the flow of intake gas flowing into the compressor 2 is made uniform, the risk of the blade vibration of the compressor 2 is reduced.

More specifically, as indicated by the arrows in FIG. 2, due to the influence of a change from a one-way flow from the intake port 30 to an annular flow, the direction of intake gas flowing near the leading edge 6 of the transverse strut 52 is different from the direction of intake gas flowing near the trailing edge 7 of the transverse strut 52. Therefore, as in the prior art, if the leading edge 6 of the transverse strut 52 is located on the virtual plane 12, the contact angle between an intake gas flow toward the leading edge 6 and the transverse strut 52 is larger than the contact angle between an intake gas flow toward the trailing edge 7 and the transverse strut 52. On the other hand, as in this embodiment, if the leading edge 6 is located closer to the intake port 30 than the virtual plane 12, the contact angle between an intake gas flow toward the leading edge 6 and the transverse strut 52 can be made closer to the contact angle between an intake gas flow toward the trailing edge 7 and the transverse strut 52. This suppresses the transverse struts 52 from obstructing the flow of intake gas.

Furthermore, in this embodiment, because each transverse strut 52 is curved such that the virtual plane 12 is tangential to the widthwise center line 82 at the trailing edge 7, the transverse struts 52 can be shaped in conformity with the flow of intake gas at the trailing edge 7. This makes is possible to remarkably obtain the effect of reducing the pressure loss.

In this embodiment, because all the transverse struts 52 have the same shape, the manufacturing cost of the bellmouth 4 can be reduced.

FIG. 4 shows an analysis result showing the pressure loss at the inlet 22 of the compressor 2 according to the intake structure 1A of this embodiment. In contrast, FIG. 5 shows an analysis result indicating the pressure loss at the inlet 22 of the compressor 2 when all the transverse struts 52, like the longitudinal struts 51, are made symmetric with respect to a plane passing through the central axis 21 of the compressor 2. Referring to FIGS. 4 and 5, a portion where the pressure loss is not less than a certain value is painted with gray. The comparison between FIGS. 4 and 5 reveals that the intake structure 1A according to this embodiment can reduce the pressure loss.

<Modification>

The struts 5 need not necessarily include the longitudinal struts 51 but may include only the transverse struts 52 as shown in FIG. 6.

With respect to the transverse strut 52, not all the transverse struts 52 need not tilt toward the intake port 30, and at least one of the transverse struts 52 (for example, as shown in FIG. 6, only the transverse struts 52 located at the lowest position) may tilt toward the intake port 30.

As shown in FIG. 6, the transverse struts 52 that tilt toward the intake port 30 may be symmetrical with respect to the chord line 81. However, as shown in FIG. 2, if the transverse struts 52 tilting toward the intake port 30 are curved, the flow direction of intake gas can be smoothly changed along the transverse struts 52.

Although not shown, referring to FIG. 2, on each of one side and the other side of the center plane 11, the lower transverse strut 52 far from the intake port 30 may be curved with a curvature larger than that of the upper transverse strut 52 close to the intake port 30. According to this configuration, although the manufacturing cost of the bellmouth 4 increases, the effect of further reducing the pressure loss can be more remarkably obtained. When the lower transverse strut 52 and the upper transverse strut 52 have the same shape, the contact angle between an intake gas flow at the leading edge 6 described above and the lower transverse strut 52 is larger than the contact angle between an intake gas flow at the leading edge 6 described above and the upper transverse strut 52. In contrast, if the lower transverse strut 52 is curved with a curvature larger than that of the upper transverse strut 52, this configuration reduces (or sometimes eliminates) a difference in contact angle with an intake gas flow between the upper and lower transverse struts 52 and 52. This is the reason why the effect of reducing the pressure loss can be more remarkably obtained.

Second Embodiment

An intake structure 1B of a compressor according to a second embodiment of the present invention will be described next with reference to FIGS. 7 and 8. In this embodiment, the same components as those of the first embodiment are denoted by the same reference numerals, and duplicate descriptions are omitted.

In this embodiment, a flange 44 is provided on the rear end of an outer casing 42 of a bellmouth 4, and an opening provided in a rear wall 32 of an intake duct 3 is closed by the flange 44. In addition, a front wall 31 of the intake duct 3 tilts forward, and a tapered wall 35 that decreases in diameter toward the rear is provided in an opening of the front wall 31. An inner casing 41 of the bellmouth 4 is joined to the inner peripheral edge of the tapered wall 35.

The inner casing 41 and the outer casing 42 each increase in diameter in an oblique direction toward the front. Accordingly, an annular channel 43 also opens in an oblique direction toward the front.

In this embodiment, the middle portion of the inner casing 41 and the outer casing 42 are connected to each other with a plurality of struts 5. The strut 5 is provided in a region where a first velocity component of intake gas flowing through the annular channel 43 in the radial direction of a compressor 2 is smaller than a second velocity component in the axial direction of the compressor 2. In other words, a region where the first velocity component of intake gas is smaller than the second velocity component is a region where the angle defined by the widthwise center line of the annular channel 43 and the central axis 21 is smaller than 45° when viewed in a cross-section passing through the central axis 21 of the compressor 2. More specifically, the strut 5 is disposed in almost the middle of the annular channel 43.

The struts 5 include two longitudinal struts 51 positioned on a center plane 11 passing through the central axis 21 of the compressor 2 and the center of the intake port 30 and two (total four) transverse struts 52 on each of one side and the other side of the center plane 11. Each of the struts 5 extends obliquely rearward from the inner casing 41 toward the outer casing 42.

The leading edge 6 and the trailing edge 7 of each longitudinal strut 51 are located on the center plane 11. Accordingly, a chord line connecting the leading edge 6 and the trailing edge 7 of each longitudinal strut 51 coincides with the center plane 11. In addition, each longitudinal strut 51 is symmetrical with respect to the chord line. Therefore, the widthwise center line bisecting each longitudinal strut 51 in the widthwise direction also coincides with the center plane 11.

On the other hand, the leading edge 6 and the trailing edge 7 of each transverse strut 52 are not located on the identical plane passing through the central axis 21 of the compressor 2. Specifically, each of the transverse struts 52 has the trailing edge 7 located on a virtual plane 12 passing through the central axis 21 of the compressor 2 and the leading edge 6 positioned on the intake port 30 side with respect to the virtual plane 12. In other words, each of the transverse struts 52 tilts toward the intake port 30, and the leading edge 6 is located at a position separated upward from the virtual plane 12.

Each transverse strut 52 is not symmetrical with respect to a chord line 81 but is curved from the leading edge 6 toward the trailing edge 7 so that the side surface of the transverse strut 52 facing the intake port 30 becomes concave. Accordingly, as shown in FIGS. 9A and 9B, the widthwise center line 82 bisecting each transverse strut 52 in the widthwise direction is a camber line positioned below the chord line 81.

In this embodiment, each transverse strut 52 is curved such that the virtual plane 12 is tangential to the widthwise center line 82 at the trailing edge 7. Furthermore, in this embodiment, on each of one side and the other side of the center plane 11, the lower transverse strut 52 far from the intake port 30 is curved with a curvature larger than that of the upper transverse strut 52 close to the intake port 30. In other words, when viewed from the axial direction of the compressor 2, the distance between the trailing edge 7 and the leading edge 6 of the lower transverse strut 52 is longer than that of the upper transverse strut 52.

As described above, in the intake structure 1B according to this embodiment, all the transverse struts 52 tilt toward the intake port 30. In a case where intake gas flowing into the intake duct 3 from the intake port 30 changes its direction toward the inlet 22 of the compressor 2 inside the annular channel 43, this configuration therefore reduces the degree of obstruction to the flow of the intake gas by the transverse struts 52. Therefore, it is possible to reduce the pressure loss when the intake gas passes through the annular channel 43. In addition, because circumferential drift at the inlet 22 of the compressor 2 is restrained, the flow of intake gas flowing into the compressor 2 is made uniform, the risk of the blade vibration of the compressor 2 is reduced.

More specifically, as indicated by the arrows in FIG. 10, due to the influence of a change from a one-way flow from the intake port 30 to an annular flow, the direction of intake gas flowing near the leading edge 6 of the transverse strut 52 is different from the direction of intake gas flowing near the trailing edge 7 of the transverse strut 52. Note that FIG. 10 is a developed view when the annular channel 43 is cut along the center of the lower longitudinal strut 51 and developed. Therefore, as in the prior art, if the leading edge 6 of the transverse strut 52 is located on the virtual plane 12, the contact angle between an intake gas flow toward the leading edge 6 and the transverse strut 52 is larger than the contact angle between an intake gas flow toward the trailing edge 7 and the transverse strut 52. On the other hand, as in this embodiment, if the leading edge 6 is located closer to the intake port 30 than the virtual plane 12, the contact angle between an intake gas flow toward the leading edge 6 and the transverse strut 52 can be made closer to the contact angle between an intake gas flow toward the trailing edge 7 and the transverse strut 52. This suppresses the transverse struts 52 from obstructing the flow of intake gas.

Furthermore, in this embodiment, because each transverse strut 52 is curved such that the virtual plane 12 is tangential to the widthwise center line 82 at the trailing edge 7, the transverse struts 52 can be shaped in conformity with the flow of intake gas at the trailing edge 7. This makes is possible to remarkably obtain the effect of reducing the pressure loss.

Since the lower transverse strut 52 is curved with a curvature larger than that of the upper transverse strut 52, the effect of reducing the pressure loss can be more remarkably obtained. The reason for this is as described in the modification of the first embodiment.

<Modification>

The struts 5 need not necessarily include the longitudinal struts 51 but may include only the transverse struts 52.

With respect to the transverse strut 52, not all the transverse struts 52 need not tilt toward the intake port 30, and at least one of the transverse struts 52 (for example, only the transverse struts 52 located at the lowest position) may tilt toward the intake port 30.

The transverse struts 52 that tilt toward the intake port 30 may be symmetrical with respect to the chord line 81. However, if the transverse struts 52 tilting toward the intake port 30 are curved, the flow direction of intake gas can be smoothly changed along the transverse struts 52.

Other Embodiments

The present invention is not limited to the above-described first and second embodiments, and can be variously modified without departing from the spirit of the present invention.

For example, one or three or more transverse struts 52 may be provided on each of one side and the other side of the center plane 11. However, at least two transverse struts 52 are desirably provided on each of one side and the other side of the center plane 11.

The present invention can also be applied to a case where the strut 5 extends in the radial direction of the compressor 2.

REFERENCE SIGNS LIST

1 intake structure
11 center plane
12 virtual plane
2 compressor
21 central axis
3 intake duct
30 intake port
4 bellmouth
41 inner casing
42 outer casing
43 annular channel
5 strut
52 transverse strut
6 leading edge
7 trailing edge
82 widthwise center line

The invention claimed is:

1. An intake structure of a compressor, the intake structure comprising:

an intake duct forming an intake port opening in a direction away from a central axis of the compressor; and a bellmouth forming an annular channel expanding from an inlet of the compressor toward an inner space of the intake duct, the bellmouth including an inner casing positioned inside the annular channel, an outer casing positioned outside the annular channel, and a plurality of struts located on both sides of a center plane passing through the central axis of the compressor and a center of the intake port, the plurality of struts connecting the inner casing and the outer casing, wherein at least one of a plurality of transverse struts among the plurality of struts has a leading edge positioned toward a side of the intake port with respect to a virtual plane, the virtual plane passing through a trailing edge of the at least one of the plurality of transverse struts and passing through the central axis of the compressor, wherein the at least one of the plurality of transverse struts is curved from the leading edge toward the trailing edge such that a side surface of the respective transverse strut facing the intake port becomes concave, and wherein two transverse struts of the plurality of transverse struts are provided on each of one side and the other side of the center plane, and the transverse strut far from the intake port on each of one side and the other side of the center plane is curved with a curvature larger than a curvature of the transverse strut close to the intake port.

2. The intake structure of the compressor according to claim 1, wherein for each transverse strut of the at least one of the plurality of transverse struts: a widthwise center line bisects the respective transverse strut in a widthwise direction such that the virtual plane is tangential to the widthwise center line at the respective trailing edge.

3. The intake structure of the compressor according to claim 1, wherein the plurality of struts are provided in a region where a first velocity component, of intake gas flowing through the annular channel, in a radial direction of the compressor is larger than a second velocity component in an axial direction of the compressor.

4. The intake structure of the compressor according to claim 1, wherein the plurality of struts are provided in a region where a first velocity component, of intake gas flowing through the annular channel, in a radial direction of the compressor is smaller than a second velocity component in an axial direction of the compressor.

5. The intake structure of the compressor according to claim 2, wherein the plurality of struts are provided in a region where a first velocity component, of intake gas flowing through the annular channel, in a radial direction of the compressor is larger than a second velocity component in an axial direction of the compressor.

6. The intake structure of the compressor according to claim 2, wherein the plurality of struts are provided in a region where a first velocity component of intake gas flowing through the annular channel in a radial direction of the compressor is smaller than a second velocity component in an axial direction of the compressor.

* * * * *